US008282743B2

(12) United States Patent
Bonnechere et al.

(10) Patent No.: US 8,282,743 B2
(45) Date of Patent: Oct. 9, 2012

(54) ALKALINE CLEANING COMPOSITIONS

(75) Inventors: Genevieve Bonnechere, Awans (BE); Baudouin Mertens, Dave (BE)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 12/809,189

(22) PCT Filed: Dec. 18, 2007 (Under 37 CFR 1.47)

(86) PCT No.: PCT/US2007/087886

§ 371 (c)(1), (2), (4) Date: Feb. 18, 2011

(87) PCT Pub. No.: WO2009/078868

PCT Pub. Date: Jun. 25, 2009

(65) Prior Publication Data

US 2011/0226293 A1 Sep. 22, 2011

(51) Int. Cl.

| | |
|---|---|
| ***B08B 3/04*** | (2006.01) |
| ***C11D 1/12*** | (2006.01) |
| ***C11D 1/72*** | (2006.01) |
| ***C11D 1/90*** | (2006.01) |
| ***C11D 3/02*** | (2006.01) |
| ***C11D 3/20*** | (2006.01) |
| ***C11D 3/30*** | (2006.01) |
| ***C11D 3/36*** | (2006.01) |

(52) U.S. Cl. ..... 134/25.2; 134/25.3; 134/39; 134/42; 510/197; 510/251; 510/252; 510/253; 510/272; 510/421; 510/426; 510/432; 510/435; 510/492; 510/499; 510/505

(58) Field of Classification Search ..... 510/197, 510/251, 252, 253, 272, 421, 426, 432, 435, 510/492, 499, 505; 134/25.2, 25.3, 39, 42
See application file for complete search history.

(56) References Cited

U.S. PATENT DOCUMENTS

| | | | | |
|---|---|---|---|---|
| 2,503,280 | A | | 4/1950 | William |
| 2,507,088 | A | | 5/1950 | Harris |
| 3,260,744 | A | | 7/1966 | Kenkichi Ito |
| 3,320,174 | A | | 5/1967 | Rubinfeld |
| 3,372,188 | A | | 3/1968 | Terence et al. |
| 3,929,678 | A | | 12/1975 | Laughlin et al. |
| 4,051,058 | A | | 9/1977 | Bowing et al. |
| 4,316,824 | A | | 2/1982 | Pancheri et al. |
| 4,565,647 | A | | 1/1986 | Llenado |
| H468 | H | | 5/1988 | Malik et al. |
| 5,677,271 | A | | 10/1997 | Bianchetti et al. |
| 5,720,964 | A | | 2/1998 | Murray |
| 5,786,319 | A | | 7/1998 | Pedersen et al. |
| 5,858,948 | A | | 1/1999 | Ghosh et al. |
| 5,929,007 | A | * | 7/1999 | Feng ..... 510/197 |
| 6,090,771 | A | * | 7/2000 | Burt et al. ..... 510/384 |
| 6,686,325 | B2 | | 2/2004 | Hoyt et al. |
| 7,199,094 | B2 | | 4/2007 | Cheung et al. |
| 2004/0171504 | A1 | | 9/2004 | Clarke et al. |
| 2004/0254085 | A1 | | 12/2004 | Rouillard et al. |
| 2006/0281653 | A1 | | 12/2006 | Hutton et al. |
| 2007/0086971 | A1 | | 4/2007 | Diet et al. |
| 2007/0123445 | A1 | | 5/2007 | Tuzi et al. |

FOREIGN PATENT DOCUMENTS

| | | | |
|---|---|---|---|
| DE | 735096 | | 5/1943 |
| DE | 102006003336 | | 7/2007 |
| EP | 0756001 | | 1/1997 |
| EP | 1167500 | | 1/2002 |
| GB | 2318801 | | 5/1998 |
| WO | WO 95/18210 | * | 7/1995 |
| WO | WO 99/21530 | | 5/1999 |
| WO | WO 2009/078867 | | 6/2009 |

OTHER PUBLICATIONS

International Search Report and Written Opinion for PCT/US2007/087886 mailed on Aug. 18, 2008.

International Search Report and Written Opinion for PCT/US2007/087884 mailed on Oct. 14, 2008.

* cited by examiner

*Primary Examiner* — Brian P Mruk

(74) *Attorney, Agent, or Firm* — Michael F. Morgan

(57) ABSTRACT

Alkaline cleaning compositions that are useful to remove burnt-on and/or baked-on soil deposits and grease are described. The alkaline cleaning compositions comprise a buffering system of a strong base and an organic acid such that the pH is maintained in the range of about 10 to about 11.2. Also described are methods of removing burnt-on or baked on soil deposits or grease.

21 Claims, No Drawings

ALKALINE CLEANING COMPOSITIONS

BACKGROUND OF THE INVENTION

The use of solvents and detergent surfactants for soil and grease removal is known. Household cleaning products for hard surfaces such as metal, glass, ceramic, plastic, porcelain and vitreous surfaces are available in powder and liquid form. Such cleaning products typically comprise solvents, surfactants and optional builder and/or abrasive additives. However, such compositions tend to leave films, spots or streaks on cleaned, unrinsed surfaces. This often necessitates a thorough scrubbing, wiping and/or rinsing of the surface and adds a time-consuming and physically laborious step for the user. Furthermore, compositions containing detergent builder salts often use inorganic phosphate builder salts, which are not entirely acceptable from an environmental perspective.

Acidic and alkaline hard surface cleaning compositions are also known in the art. Various formulations of such cleaning compositions have been produced that remove grease and other soil deposits. These commercially available products are generally suited for removal of certain types of deposits but are generally not effective in removal of burnt-on or baked-on soil or grease.

Therefore, there is an ongoing need for effective hard surface cleaning compositions that exhibit superior cleaning performance, particularly with respect to burnt-on and baked-on soil or grease, but that are environmentally friendly and avoid undesirable residues.

SUMMARY OF THE INVENTION

A cleaning composition comprising:

(i) a buffering system comprising a strong base and an organic acid;

(ii) an alkanolamine in an amount of about 0.01 to about 5% by weight of the cleaning composition;

(iii) at least one surfactant chosen from a zwitterionic surfactant, a non-ionic surfactant, an ionic surfactant and mixtures thereof; and (iv) an organic solvent chosen from lower alkanols, glycol ethers and diethers, and mixtures thereof;

wherein the pH of the composition is about 9 to about 13.

A composition useful for removing baked-on or burnt on soils from a surface, the composition comprising:

(i) a buffering system comprising about 0.2 to about 1% by weight of the composition of sodium hydroxide, and about 0.5 to about 2.5% by weight of the composition of citric acid;

(ii) about 0.01 to about 5% monoethanolamine;

(iii) about 1 to about 4.5% cocoamidopropyl betaine;

(iv) about 0.5 to about 1.5% of a water soluble copolymer;

(v) about 1 to about 3% ethanol; and (vi) about 2 to about 4% propylene glycol n-butyl ether;

wherein the pH of the composition is about 9 to about 13.

DETAILED DESCRIPTION OF THE INVENTION

As used herein, ranges are a shorthand for describing each and every value within a range, including endpoints. All references cited in the present disclosure are hereby incorporated by reference in their entirety. In the event of a conflict between a definition in the present disclosure and that of a cited reference, the present disclosure controls.

In certain embodiments, the present invention is directed to cleaning compositions that are suitable for use on surfaces that have burnt-on and/or baked-on deposits of compounds such as soil or grease. The compositions of the present invention are directed to solutions comprising a strong base, an organic acid, an alkanolamine, a surfactant, a solvent and a water soluble dispersing copolymer, wherein the pH of the composition is, in various embodiments, about 9 to about 13, about 10 to about 12, about 10.2 to about 11.5 and about 10.5 to about 11.2.

In certain embodiments, these compositions are alkaline cleaning compositions comprising buffering systems such that the pH is maintained at a desirably alkaline yet safe level (i.e., about 9 to about 13) while nevertheless having a high alkali reserve, resulting in superior cleaning performance, particularly for use on burnt-on and baked-on soils or grease.

Buffering System

The use of a buffering system comprising a high concentration of a strong base and an organic acid has herein been found to aid in the maintenance of the pH of the composition at the desired level. In certain embodiments, a buffering system of the present invention comprises a strong base and an organic acid. In certain embodiments, the organic acid may create a buffering system in combination with a high concentration of the strong base. Buffers and buffering systems are typically used in such a way as to resist changes in the pH of a solution, thereby keeping the pH of the solution at or near a desired level.

The embodiments of the present invention provide a cleaning composition comprising a strong base. The term "strong base" is understood by one of ordinary skilled in the art to describe highly ionic bases, i.e., those whose ions separate in solution. Examples of useful strong bases for the present invention include bases of alkali metals, e.g., sodium hydroxide ("caustic soda"), potassium hydroxide, lithium hydroxide and the like. In certain embodiments, a base can be characterized as a strong base when it has a pKa of about 13 or above. In various embodiments, the strong base is present in an amount of about 0.01 to about 5%, about 0.1 to about 3%, about 0.2 to about 2%, or about 0.5 to about 1% by weight of the total composition.

The cleaning compositions of the present invention further comprise an organic acid. The term "organic acid" is understood by one of ordinary skill in the art to describe an organic compound that has acidic properties. Examples of acids that are useful for the present invention include polyprotic acids such as, for example, citric acid, lactic acid, phosphoric acid, phosphonic acid or mixtures thereof. In various embodiments, the acid is present in an amount of about 0.01 to 5%, about 0.1 to about 3%, about 0.2 to about 2% or about 0.5 to about 2% by weight of the total composition.

In various embodiments, this organic acid is a polyprotic acid; this is advantageous because more than one hydrogen ion is available to offset the addition of base. Typically, the multiple protons on the acid have different dissociation constants, so an additional proton is dissociated at higher concentrations of base, thereby maintaining the overall pH of the solution below highly caustic levels. The buffering system may maintain the apparent pH of the formulation at or below the desired pH level while also maintaining a high alkaline reserve. This high alkaline reserve may be beneficial, as it may providing an excess of alkaline solution, which may in turn further contribute to removal of the baked and burnt-on soil deposits.

In various embodiments, the compositions of the present invention comprise a buffering system as described above, comprising about 0.2 to about 5% by weight of the composition of strong base and about 0.5 to about 5% by weight of the composition of organic acid; or about 0.3 to about 2.5% by weight of the composition of strong base and about 0.5 to about 2% by weight of the composition of organic acid.

In certain embodiments of the present invention, the presence of the previously mentioned buffering system along with a mixture of increased levels of surfactant and solvent provides superior cleaning against grease and other soil deposits as well as improved aesthetics of the cleaned surface, including enhanced surface shine and minimal residue.

In certain embodiments, the cleaning compositions are alkaline formulations comprised of a strong base such as sodium hydroxide; an organic acid such as a polyprotic acid, e.g., citric acid; an alkanolamine such as methanolamine; at least one surfactant and an organic solvent. Using the buffering system of a strong base and an organic acid buffer such as a polyprotic acid permits the pH of the final product to be stably maintained at a certain level The cleaning compositions may further comprise an alkanolamine, for example, monoethanolamine, diethanolamine or triethanolamine. In various embodiments, the alkanolamine is present in an amount of about 0.1 to about 5%, about 1 to about 3%, about 1.5 to about 2.5% or about 1.75 to about 2% by weight of the total composition. In certain embodiments, an alkanolamine such as monoethanolamine may be added to the compositions as a solvent, but may additionally contribute to the buffering system thereby aiding in the maintenance of the desired pH level, e.g., in various embodiments, about 9 to about 13, about 10 to about 12, about 10.2 to about 11.5 and about 10.5 to about 11.2; while retaining the desired activity against the burnt-on and/or baked-on soil deposits. This is achieved by, inter alia, providing a high alkaline reserve and further permitting the use of surfactants and solvents to provide activity against soil or grease while delivering a superior shine to the surface.

The compositions of the present invention may further comprise at least one surfactant and at least one solvent. The surfactants and solvents may aid in the removal of grease and other soil deposits while providing a superior shine and minimal residue to the surface being cleaned. In certain embodiments, the compositions of the present invention comprise an increased amount of surfactant and/or solvent as compared to previous formulations; these increased surfactant and/or solvent levels contribute to the overall cleaning performance and aesthetic appearance of the surfaces after use.

Surfactants

In various embodiments, the cleaning compositions may further comprise one or more surfactants. For example, in certain embodiments, the compositions may comprise at least one of a zwitterionic, non-ionic or anionic surfactant; or a mixture of any of these foregoing. For example, zwitterionic surfactants (such as cocoamidopropyl betaine, lauryl/myristyl dimethyl betaine or cocoamidopropyl hydroxyl betaine) and non-ionic surfactants (such as alkoxylated alcohol non-ionic surfactants, e.g., polyethoxylated alcohol, lauroyl amine oxide and cocoamidopropyl amine oxide or alkyl polyglucoside) may be useful for the present embodiments. In various embodiments, the compositions of the present invention comprise cocoamidopropyl betaine in an amount of about 0.1 to about 4.5%, about 1 to about 4.25%, about 1%, about 4.2%, about 1.2% or about 4% by weight of the total composition.

In various embodiments, the compositions comprise a non-ionic surfactant such as, e.g., a polyethoxylated alcohol. An example of an alkoxylated alcohol non-ionic surfactant that may be useful for the present invention includes a composition of Formula I:

$$CH_3(CH_2)_m—(O—CH_2—CH_2)_n—OH, \quad (I)$$

wherein m is 7 to 15; and n represents an average degree of ethoxylation for the mixture of about 1 to about 15. In various embodiments, the surfactants used are one or more mixtures comprising compounds of the above formula wherein n is 7 to 9 or 2 to 3. The polyethoxylated alcohol may be, for example, a mixture of compounds of Formula I wherein m is 8 to 10, and n represents an average degree of ethoxylation for the mixture of about 1 to about 15.

In various embodiments, the non-ionic surfactant present in the compositions of the present invention may be aliphatic ethoxylated nonionic surfactants, for example, those that are commercially well known and include the primary aliphatic alcohol ethoxylates and secondary aliphatic alcohol ethoxylates. The length of the polyethenoxy chain can be adjusted to achieve the desired balance between the hydrophobic and hydrophilic elements.

The nonionic surfactant class also may include the condensation products of a higher alcohol (e.g., an alkanol containing 8 to 16 carbon atoms in a straight or branched chain configuration) condensed with about 2 to about 20 moles of ethylene oxide, for example, lauryl or myristyl alcohol condensed with about 16 moles of ethylene oxide (EO), tridecanol condensed with about 6 to about 15 moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to 14 carbon atoms in length and wherein the condensate contains either about 6 moles of EO per mole of total alcohol or about 9 moles of EO per mole of alcohol and tallow alcohol ethoxylates containing about 6 EO to about 11 EO per mole of alcohol.

Illustrative examples of the foregoing nonionic surfactants include, but are not limited to, the Neodol® or Dobanol® ethoxylates (Shell Co.), which are higher aliphatic, primary alcohol containing 9 to 15 carbon atoms, such as $C_9$-$C_{11}$ alkanol condensed with about 4 to about 10 moles of ethylene oxide (Neodol 91-8®, Dobanol 91-8®, Neodol 91-5®) or about 2.5 moles of ethylene oxide (Neodol 91-2.5®), $C_{12}$-$C_{13}$ alkanol condensed with about 6.5 moles ethylene oxide (Neodol 23-6.5®), $C_{12}$-$C_{15}$ alkanol condensed with about 12 moles ethylene oxide (Neodol 25-12®), $C_{14}$-$C_{15}$ alkanol condensed with about 13 moles ethylene oxide (Neodol 45-13®), and the like. Such ethoxamers have an HLB (hydrophobic lipophilic balance) value of about 8 to about 15 and give good 0/W emulsification, whereas ethoxamers with HLB values below 7 contain less than 4 ethyleneoxide groups and tend to be poor emulsifiers and poor detergents. As used throughout the present disclosure, the trade names "Neodol" and "Dobanol" can be used interchangeably to refer to the same compounds, with the respective trade names used according to the geographies in which they are available.

Additional satisfactory water soluble alcohol ethylene oxide condensates include, but are not limited to, the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type include $C_{11}$-$C_{15}$ secondary alkanol condensed with either 9 EO (Tergitol 15-S-9®) or 12 EO (Tergitol 15-S-12®) marketed by Union Carbide (USA).

The water soluble nonionic surfactants, which can be utilized in this invention, also include aliphatic ethoxylated/ propoxylated nonionic surfactants, which are depicted by the formulas:

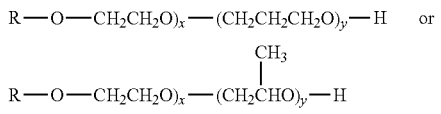

wherein R is a branched chain alkyl group having 10 to 16 carbon atoms, or an isotridecyl group and x and y are independently numbered from 0 to 20. In certain embodiments, the ethoxylated/propoxylated nonionic surfactant is Plurafac® 300 manufactured by BASF (New Jersey, USA).

In various embodiments, the compositions of the present invention may comprise one or more ionic surfactants. For example, the compositions of the present invention may comprise an anionic surfactant. The anionic surfactant may be any of the anionic surfactants known or previously used in the art of aqueous surfactant compositions. Suitable anionic surfactants include, but are not limited to, alkyl sulfates, alkyl ether sulfates, alkaryl sulfonates, alkyl succinates, alkyl sulfosuccinates, N-alkoyl sarcosinates, alkyl phosphates, alkyl ether phosphates, alkyl ether carboxylates, alkylamino acids, alkyl peptides, alkoyl taurates, carboxylic acids, acyl and alkyl glutamates, alkyl isethionates, and alpha-olefin sulfonates, especially their sodium, potassium, magnesium, ammonium and mono-, di- and triethanolamine salts. The alkyl groups generally contain 8 to 18 carbon atoms and may be unsaturated. The alkyl ether sulfates, alkyl ether phosphates and alkyl ether carboxylates may contain, in various embodiments, 1 to 10 or 1 to 3 ethylene oxide or propylene oxide units per molecule.

Examples of suitable anionic surfactants include sodium and ammonium lauryl ether sulfate (with 1, 2 or 3 moles of ethylene oxide), sodium, ammonium, and triethanolamine lauryl sulfate, disodium laureth sulfosuccinate, sodium cocoyl isethionate, sodium $C_{12}$-$C_{14}$ olefin sulfonate, sodium laureth-6 carboxylate, sodium $C_{12}$-$C_{15}$ pareth sulfate, sodium methyl cocoyl taurate, sodium dodecylbenzene sulfonate, sodium cocoyl sarcosinate, triethanolamine monolauryl phosphate, and fatty acid soaps.

The compositions of the present invention may additionally include an organic solvent, e.g., a lower alkanol, a glycol ether or diether such as, for example, ethanol, propylene glycol, ethylene glycol, dipropylene glycol n-butyl ether, propylene glycol n-butyl ether or a phenoxyalkanol such as, for example, phenoxyethanol, phenoxyisopropanol; or mixtures or any of the above-described organic solvents. For example, in certain embodiments, the compositions of the present invention may include at least one ingredient chosen from ethanol, propylene glycol n-butyl ether or dipropylene glycol monobutyl ether. When present in various embodiments, the organic solvent may be present in an amount of about 1 to about 10%, about 2 to about 8%, about 3 to about 6%, about 3.5 to about 5.5% or about 5% by weight of the composition. In certain embodiments, the compositions of the present invention comprise about 1 to about 3% ethanol and about 2.5 to about 3.5% propylene glycol n-butyl ether or dipropylene glycol monobutyl ether.

The compositions of the present invention may also include one or more solubilizing agents, such as, for example, hexylene glycol, pentaethylene glycol hexyl ether, triethylene glycol hexyl ether, sodium chloride and/or sodium cumene or sodium xylene sulfonate. In certain embodiments, the compositions of the present invention may comprise about 0.5 to about 3% sodium cumene sulfonate.

The compositions of the present invention may further comprise polymers such as hydrophobically modified polycarboxylic acids and/polyacrylic sodium salts, and/or dispersants that are surfactant-soluble carboxylated polyelectrolyte copolymers; for example, sodium salts of $C_8$ olefin/maleic acid copolymers having a molecular weight of about 5,000 to about 15,000, wherein the copolymers contain about 10% to about 90% of $C_8$ olefin monomer. Examples of commercially available copolymers of the foregoing type include, for example, carboxylated polyelectrolyte copolymers such as those available under the trade name "Acusol 460 NK" from Rohm and Haas, Inc. (Pennsylvania, USA) or "Sokalan CP9" from BASF (New Jersey, USA)) In various embodiments, the polymer may be present in amounts of about 0.1% to about 2%, about 0.2 to about 1.5%, or about 0.25% to about 1% by weight of the composition.

The alkaline cleaning compositions of the present invention may also comprise one or more amines, such as, for example, alkanolamines and derivatives thereof. Examples of useful alkanolamines include monoalkanolamines, dialkanolamines or trialkanolamines or mixtures thereof. In certain embodiments, the amine is an alkanolamine chosen from monoethanolamine, diethanolamine, triethanolamine or mixtures thereof. For example, useful monoalkanolamines include those having alcohol moieties with carbon chains having 1 to 4 carbons. Generally, the amines serve primarily as solvents but may also provide buffering capacity during use. The amines may also contribute to the shine/residue performance of the cleaning composition. For example, one useful monoalkanolamine for the embodiments of the present invention is monoethanolamine.

Zwitterionic surfactants may also be useful for the present invention. Such surfactants contain both a cationic group and an anionic group. Preferred zwitterionic surfactants of the present invention contain both a quaternary ammonium group and an anionic group selected from sulfonate and carboxylate groups. These anionic groups are desirable as they tend to maintain their amphoteric character over most of the pH range of the formulation. In certain embodiments, the zwitterionic surfactant used is cocamidopropyl betaine.

The non-ionic synthetic organic surfactants which are employed in the described composition are generally the condensation product of an organic aliphatic or alkyl aromatic hydrophobic compound containing a terminal hydroxy group and hydrophilic ethylene oxide group. Such detergents are prepared readily by condensing the hydrophobic organic compound with ethylene oxide or with the polyhydration product thereof, polyethylene glycol. Further, the length of the polyethenoxy chain can be adjusted to achieve the desired balance between the hydrophobic and hydrophilic elements.

The non-ionic surfactants include the condensation products of a higher alcohol (e.g., an alkanol containing 8 to 18 carbon atoms in a straight chain or branched chain configuration) condensed with about 2 to about 30 moles of ethylene oxide, for example, lauryl or myristyl alcohol condensed with about 6 moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing about 6 EO to about 11 EO per mole of alcohol.

Ionic surfactants which can be used in the present invention are preferably anionic surfactants. Such surfactants are useful to enhance the stability of the formulation as well as to provide additional degreasing activity. Suitable water-soluble anionic surfactants include those surface-active or detergent compounds which contain an organic hydrophobic group containing generally 8 to 26 carbons and preferably 10 to 18 carbon atoms in their molecular structure and at least one water-solubilizing group which is a sulfonate group, so as to form a water-soluble detergent. Usually, the hydrophobic group will include or comprise a $C_8$-$C_{22}$ alkyl, aryl or acyl group. Other suitable anionic surfactants are the olefin sulfonates, including long-chain alkene sulfonates, long-chain hydroxyalkane sulfonates or mixtures of alkene sulfonates and hydroxyalkene sulfonates. In certain embodiments, the anionic surfactants used include alkyl sulfonates, alkyl aryl sulfonates and aryl alkyl sulfonates, e.g., $C_{12}$-$C_{16}$ paraffin sulfonate.

The cleaning composition of the present invention comprises at least one organic solvent. Such organic solvents may include, for example, $C_2$-$C_5$ mono, dihydroxy, or polyhydroxy alkanols and/or an ether or diether, such as ethanol, isopropanol, dipropylene glycol methyl ether, diproyleneglycol monobutyl ether, propylene glycol n-butyl ether, and mixtures thereof. In certain embodiments, the organic solvent is freely soluble in water. In certain embodiments, the organic solvent is at least one of ethanol and dipropylene glycol methyl ether, both of which are miscible with water. In various embodiments, the organic solvent is present in an amount of about 1 to about 3%, about 1.5 to about 2.5% or about 2% by weight of the total composition.

In certain embodiments, the present invention also provides methods for removing burnt-on and/or baked-on soil or grease from a surface, comprising applying a formulation of the invention to the surface, and removing the formulation, e.g., by rinsing with a solvent such as water or wiping with a cloth, sponge, brush, scrubbing implement or the like.

The compositions may optionally further comprise one or more other desirable constituents including, but not limited to: water, a perfume or fragrance, an abrasive agent, a disinfectant, a dye, a radical scavenger, a sequestering agent, a thickening agent, a chelating agent, a preservative or a mixture of any of these constituents.

The compositions as provided herein are described and claimed with reference to their ingredients, as is usual in the art. As would be evident to one skilled in the art, the ingredients may in some instances react with one another, so that the true composition of the final formulation may not correspond exactly to the ingredients listed. Thus, it should be understood that the invention extends to the product of combination of the listed ingredients.

In other embodiments, the present invention is directed to methods of preparing a composition comprising combining the ingredients as set forth for any of the foregoing formulations; in other embodiments, the method may comprise dilution of the various ingredients with water. In other embodiments, the present invention is directed to methods of removing burnt-on or baked-on soil or grease from a surface, comprising the step of applying the cleaning composition of claim 1 onto the surface, as well as cleaning systems comprising the present compositions in a spray bottle with a nozzle.

The invention can be further illustrated by the following non-limiting Example.

EXAMPLE

Compositions according to the present invention were prepared. The details are shown below:

| Ingredient | Formulation A | Formulation B |
|---|---|---|
| Monoethanolamine | 1.9 | 1.9 |
| Caustic soda (NaOH) | 0.32 | 0.7 |
| Citric acid | 0.6 | 1.9 |
| $C_{9-11}$ alcohol EO 2.5:1 | 0.5 | 0.5 |
| Cocoamidopropylbetaine (zwitterionic surfactant) | 1.20 | 4 |
| Propylene glycol mono n-butyl ether | 3 | 3 |
| Ethanol | 2 | 2 |
| Acusol 460NK (thickener) | 0.25 | 1 |
| Sodium cumene sulfonate (anionic surfactant) | 0.6 | 1.6 |
| Perfume | 0.33 | 0.33 |
| Water, Minors | QS | QS |
| pH | 11 | 11 |

Formulations A and B exhibited superior efficacy against burnt-on soil, grease, burnt-on gravy sauce, baked-on soil, and provided improved residue pattern shine over known compositions in the art.

We claim:

1. A cleaning composition comprising:

(i) a buffering system comprising a strong base having a pKa of at least 13 and at least one acid selected from an organic acid, phosphonic acid, and phosphoric acid;

(ii) monoethanolamine;

(iii) a surfactant system comprising cocoamidopropyl betaine, a polyethoxylated alcohol, and sodium cumene sulfonate;

(iv) ethanol; and (v) propylene glycol n-butyl ether, wherein the pH of the composition is about 9 to about 13.

2. The cleaning composition of claim 1, wherein the polyethoxylated alcohol comprises a $C_9$-$C_{11}$ alkanol condensed with about 2.5 moles of ethylene oxide.

3. The cleaning composition of claim 1, wherein the pH of the composition is about 10 to about 12.

4. The cleaning composition of claim 1 wherein the organic acid is chosen from citric acid, lactic acid, formic acid, oxalic acid, acetic acid, salicylic acid, or mixtures thereof.

5. The cleaning composition of claim 1 wherein the strong base is chosen from sodium hydroxide, potassium hydroxide, lithium hydroxide or mixtures thereof.

6. The cleaning composition of claim 1 wherein the polyethoxylated alcohol comprises at least one molecule of Formula 1:

$$CH_3(CH_2)_m—(O—CH_2—CH_2)_n—OH \quad (I)$$

wherein m is 8 to 12 and n represents an average degree of ethoxylation for the mixture of about 1 to about 15.

7. The cleaning composition of claim 1 further comprising an anionic surfactant which is a sodium or ammonium lauryl ether sulfate with 1, 2 or 3 moles of ethylene oxide.

8. The cleaning composition of claim 1 further comprising an anionic sulfonate surfactant.

9. The cleaning composition of claim 1 further comprising a surfactant soluble carboxylated polyelectrolyte copolymer.

10. The cleaning composition of claim 1 wherein the strong base is present in an amount of about 0.01 to about 5% by weight of the cleaning composition.

11. The cleaning composition of claim 1 wherein the organic acid is present in an amount of about 0.01 to about 5% by weight of the cleaning composition.

12. The cleaning composition of claim 1 wherein the cocoamdiopropyl betaine is present in an amount by weight of about 1 to about 8% by weight of the cleaning composition.

13. A composition useful for removing baked-on or burnt on soils from a surface, the composition comprising:

(i) a buffering system comprising about 0.2 to about 1% by weight of the composition of sodium hydroxide and about 0.5 to about 2.5% by weight of the composition of citric acid;

(ii) about 0.01 to about 5% monoethanolamine;

(iii) about 1 to about 4.5% cocoamidopropyl betaine;

(iv) about 0.5 to about 1.5% of a surfactant soluble carboxylated polyelectrolyte copolymer;

(v) about 1 to about 3% ethanol; and (vi) about 2 to about 4% propylene glycol n-butyl ether;

wherein the pH of the composition is about 9 to about 13.

14. A method of removing burnt-on or baked-on soil or grease from a surface comprising the step of applying the cleaning composition of claim 1 onto the surface.

15. The composition of claim 13 further comprising a $C_{9-11}$ alcohol with a degree of ethoxylation of about 2.5 and sodium cumene sulfonate.

16. A method of removing burnt-on or baked-on soil or grease from a surface comprising the step of applying the cleaning composition of claim 13 onto the surface.

17. A cleaning composition comprising:

(i) a buffering system comprising about 0.2 to about 1% by weight of the composition of sodium hydroxide and about 0.5 to about 2.5% by weight of the composition of citric acid;

(ii) an alkanolamine;

(iii) a surfactant system comprising a zwitterionic surfactant, a non-ionic surfactant, an anionic surfactant and mixtures thereof; and (iv) an organic solvent system comprising a $C_2$-$C_5$ alkanol and a glycol ether;

wherein the pH of the composition is about 9 to about 13.

18. The cleaning composition of claim 17 further comprising a surfactant soluble carboxylated polyelectrolyte copolymer.

19. The cleaning composition of claim 17, wherein the organic solvent system comprises ethanol and propylene glycol n-butyl ether.

20. The cleaning composition of claim 17, wherein the surfactant comprises cocoamidopropyl betaine, and a $C_9$-$C_{11}$ alkanol condensed with about 2.5 moles of ethylene oxide, and sodium cumene sulfonate.

21. A method of removing burnt-on or baked-on soil or grease from a surface comprising the step of applying the cleaning composition of claim 17 onto the surface.

* * * * *